United States Patent [19]

Garlinghouse

[11] 4,085,587

[45] Apr. 25, 1978

[54] FAIL SAFE LIQUID POWER DEVICE

[75] Inventor: Ronald E. Garlinghouse, Duarte, Calif.

[73] Assignee: Leslie H. Garlinghouse, Los Angeles, Calif.

[21] Appl. No.: 748,484

[22] Filed: Dec. 8, 1976

Related U.S. Application Data

[62] Division of Ser. No. 628,154, Nov. 3, 1975, abandoned, and Ser. No. 776,101, Mar. 10, 1977.

[51] Int. Cl.[2] ..... F15B 11/06

[52] U.S. Cl. ..... 60/403; 60/404; 60/413; 60/DIG. 2

[58] Field of Search ..... 60/403, 404, 413, 418, 60/DIG. 2; 91/275, 459

[56] References Cited

U.S. PATENT DOCUMENTS

| | | | |
|---|---|---|---|
| 1,948,951 | 2/1934 | Walker | 60/DIG. 2 |
| 2,392,471 | 1/1946 | Fox | 60/418 X |
| 2,641,106 | 6/1953 | Jelinek | 60/403 X |
| 2,900,960 | 8/1959 | Gratzmuller | 91/459 X |
| 3,225,663 | 12/1965 | Pelisson | 91/305 |
| 3,533,234 | 10/1970 | Futamata | 60/400 X |
| 3,695,023 | 10/1972 | Hayashi et al. | 91/275 X |

*Primary Examiner*—Edgar W. Geoghegan

[57] ABSTRACT

A fluid power device such for example as one for opening and closing clam shell gates is operated by a ram under fluid pressure. A tank is provided for storing fluid under pressure and by a system of valving extension of the ram, as for a gate opening operation is inhibited until enough fluid under pressure is stored in the tank to assure completion of reverse operation of the ram to close the gates.

10 Claims, 4 Drawing Figures

FAIL SAFE LIQUID POWER DEVICE

This is a division of copending application Ser. No. 628,154 filed Nov. 3, 1975 now abandoned and application Ser. No. 776,101 filed Mar. 10, 1977 pending.

The device makes use of a fluid actuated ram for doing work, customarily referred to as a hydraulic ram. A commercial construction device usually manipulated by employment of such a ram consists of clam shell gates such as are used on concrete placement buckets. Another consists of a pair of hooks such as are used by cranes for lifting and placing construction material. These however are merely examples in that the reciprocating action of a ram may be adapted to a great assortment of uses.

A popular pneumatic gate actuating device for concrete buckets may be found disclosed in U.S. Pat. No. 2,856,222, which makes use of a portable air pressure reservoir for the purpose of manipulating a ram. A more recent gas actuated power device is found disclosed in U.S. Pat. No. 3,104,125 where a portable gas pressure device is coupled with mechanisms capable of operating semi-automatically.

Although devices of the kind disclosed in the patents mentioned have long been effective, there has been a noteworthy shortcoming in that there is no assurance after a pair of clam shell gates for example, have been opened, that there is enough air pressure left to completely close them. Gauges and the like of course can be made use of but such expedients are always subject to human error. When for example, a large bucket of wet concrete has been opened or perhaps partially opened for dumping the load, inability to promptly and effectively close the gates before dumping the entire load could be extremely disadvantageous, causing wet concrete to be dumped in the wrong place. Inability to disengage a hook could be equally disadvantageous.

It is therefore among the objects of the invention to provide a new and improved fail safe fluid power device of a reciprocating character where operation in one direction is inhibited until there is assurance that operation in a reverse direction can be run to completion once operation in a forward direction has been undertaken.

Another object of the invention is to provide a new and improved fail safe fluid power device which is completely portable and which automatically assures a complete reciprocating cycle of the ram prior to initiation of operation.

Still another object of the invention is to provide a new and improved fluid ram system operating under liquid pressure wherein adequate pressure and volume must be stored to complete a reverse operation prior to initiation of a forward operation and wherein there is an overload relief capable of preventing strain on the system should forward operation be interrupted for any reason.

With these and other objects in view, the invention consists of the construction, arrangement, and combination of the various parts of the device, whereby the objects contemplated are attained, as hereinafter set forth, pointed out in the appended claims and illustrated in the accompanying drawings.

Figures 1, 2:
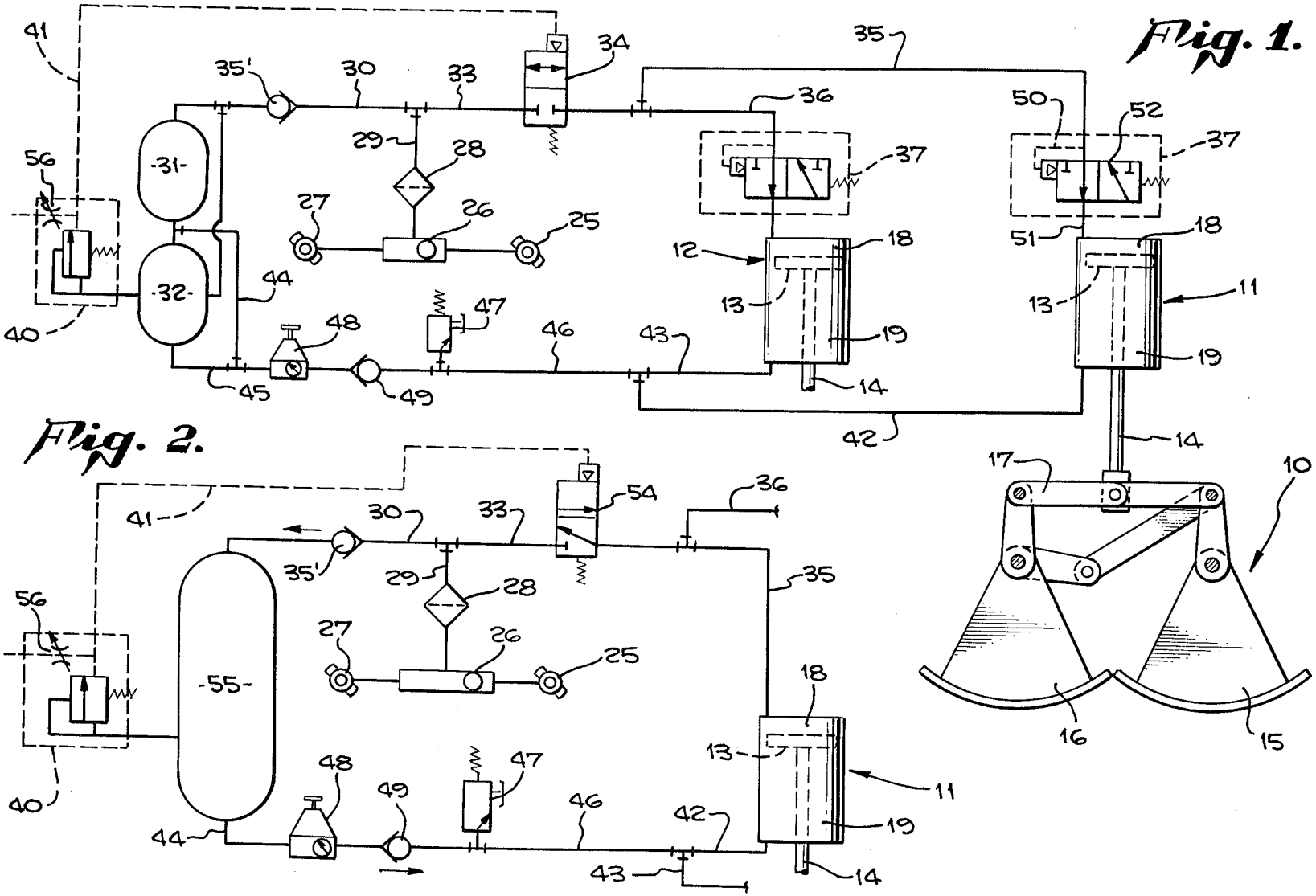
FIG. 1 is a schematic representation of one form of the device which makes use of gas pressure, applied to twin rams operable at opposite ends of a pair of clam shell gates.
FIG. 2 is a schematic representation of a second form of the system making use of air pressure.

In one embodimet of the invention chosen for the purpose of illustration there is shown a pair of clam shell gates indicated generally by the reference character 10 manipulated at one end by a fluid actuated ram 11 and at the other end by a fluid actuated ram 12. The ram 11 is provided with a piston 13 and piston rod 14 which performs the work, namely, opening and closing gates 15 and 16 by use of the mechanism 17. The piston 13 separates the ram into a forward acting chamber 18 and a reverse acting chamber 19, the forward acting chamber being one which under power opens the gates and the reverse acting chamber being one which under power closes the gates. The ram 12 is similarly equipped and operates a mechanism like the mechanism 17, not shown, attached to the opposite ends of the gate. On occasions one ram only may be employed.

A supply of air pressure to 25 from an outside source is accepted by a selector valve 26. There is a similar supply to 27, normally on the opposite side of the concrete bucket where the device is one set up to manipulate the clam shell gates. Air from one or another of the supplies after passing to the selector valve 26 travels through a strainer 28 and an air passage 29. From the passage 29, depending on the condition of the system, air will travel either through an air passage 30 to air receivers 31 and 32 or through air passage 33 to a two-way two position pilot operated valve 34. The valve 34 is normally biased by conventional means, as for example a spring, to the position of FIG. 1. A check valve 35' allows passage to the air receivers but blocks air traveling from the receivers.

From the pilot operated valve 34 air is adapted to travel both through an air passage 35 to the ram 11 and an air passage 36 to the ram 12. Acting in conjunction with the ram 11 is a quick exhaust valve 37 in the air passage 35. A similar quick exhaust valve 37 accommodates the ram 12 and is in the air passage 36. The quick exhaust valves 37 are conventional valves biased toward exhaust position by conventional means, such as, for example, a spring, and respectively urged out of exhaust position by air pressure in passages 35 and 36.

Connected to the air receivers is a sequence valve means 40, and a pilot line 41 connects the sequence valve 40 means with the pilot operated valve 34.

To complete the fluid pressure loop air passages 42 and 43 leading respectively to the reverse acting chambers 19 of the rams 11 and 12 are connected to the air receivers 31 and 32. Actually there is provided a line 44 from the air receiver 31 and a line 45 from the air receiver 32 which join a common air passage 46. In the air passage 46 is a pressure relief valve 47, a pressure regulator 48 and a check valve 49, the check valve 49 being oriented to permit flow to the rams but prevent flow from the rams.

In operation of the system as shown in FIG. 1 let it be assumed that the pressure of the air supply 25 is 60 pounds per square inch with the selector valve 26 moved to accept the air under pressure and pass it through the air passage 29. In the position of adjustment shown in FIG. 1 passage of air is blocked by adjustment of the pilot valve 34, consequently, air at the selected pressure passes through the air passage 30 past the check valve 35′ and into the air receivers 31 and 32. By setting the sequence valve means 40 to a pressure of 60 pounds per square inch the sequence valve means will maintain the pilot line 41 closed until both air receivers are pressurized to 60 pounds per square inch. At that point the sequence valve means will pass air under pressure to the pilot operated vavle 34 causing it to assume a second position of adjustment which permits air to flow from the air passage 33 to the air passages 35 and 36 and to the forward acting chambers 18 of the respective rams 11 and 12. As a consequence, the pistons 13 are moved downwardly in a direction causing the gates 15 and 16 to open. During this portion of the cycle air pressure for example in the air passages 35 and 36 flows through a pilot line in the respective quick exhaust valve 37 to adjust the valve to the position shown in FIG. 1 so that there is flow of air under pressure to the forward acting chamber of each of the rams 11 and 12.

When the gates are to be closed a reverse movement is necessary. To accomplish this air pressure in the air passages 35 and 36 is cut off by disconnecting the supply of air to 25 or 27. When this happens a change in air pressure in the pilot line 50, believed at 25 or 27, causes a shift in adjustment of the quick exhaust valve to a second position wherein the forward acting chamber 18 is vented to exhaust through the valves 37 and air flow in the air passages 35 and 36 is blocked.

Simultaneously, air from the air receivers 31 and 32 at 60 pounds per square inch is converted to air pressure at 18 pounds per square inch for example by operation of and wherein the valve 54 is normally biased by conventional means as for example a spring, to the position of FIG. 2 the pressure regulator 48. The specific pressure is somewhat optional, 18 pounds per square inch being merely by way of example. Under such circumstances the pressure relief valve 47 is set at a pressure higher than that of the pressure regulator, 20 pounds per square inch for example in the chosen illustration. As a consequence, air at 18 pounds per square inch passes the check valve 49, cannot be vented through the pressure relief valve 47 and therefore flows through the respective air passages 42 and 43 to the reverse acting chamber 19 of each of the rams 11 and 12, causing the pistons 13 and attached rods 14 to move upwardly to close the gates 15 and 16.

Closing can be stopped at any point prior to complete closing by merely again manipulating the selector valve 26 to introduce air under pressure to the air passages 35 and 36 which will change the adjustment of the quick exhaust valves and again pressurize the forward acting chambers 18. Since air pressure in the forward acting chambers 18 is always at the higher pressure namely, 60 pounds per square inch, in the example chosen, the pressure differential on opposite sides of the piston 13 will be 42 pounds and the piston can be moved in the chosen direction despite the presence of air at 18 pounds per square inch pressure in the return chamber 19. As the piston continues to move expelling air from the return chamber 19 at 18 pounds per square inch, pressure is built up to 20 pounds by reason of the setting of the pressure relief valve 47 and the air is exhausted by the pressure relief valve at the 20 pound pressure thus permitting the piston to continue its travel.

In the embodiment of the invention of FIG. 2 presence of the quick exhaust valve is dispensed with a different type of pilot operated valve 54 is made use of. In this example also only one air receiver 55 is employed. In the operation of the system set up in this fashion, prior to the time when the sequence valve means 40 indicates pressure in the air receiver 55, to be less than 60 pounds per square inch, in the example chosen, air under pressure from the source 25 is blocked by the adjustment shown of the pilot operated valve 54. When the air receiver has been pressurized to 60 pounds per square inch the sequence valve member 40 will communicate with the pilot operated valve 54 through the pilot line 41 causing it to assume a new adjustment wherein air in the air passage 33 is passed directly to the air passages 35 and 36. This means that the forward acting chambers 18 are pressurized causing the piston 13 and piston rod 14 to move downwardly in the illustration as shown.

Conversely, when the piston is to be moved in the opposite direction the source of air pressure at 25 is discontinued allowing such connection as is provided to exhaust directly to atmosphere. This means that since 25 is open to atmosphere when pressure supplied to it is discontinued simultaneously air in the respective forward acting air chambers 18 will be vented through the pilot operated valve 54 and through the air passages 33 and 29 and the selector valve 26 to atmosphere. Meanwhile air which has accummulated in the air receiver 55 passes through the line 44 to the pressure regulator 48 where the pressure is reduced to 18 pounds per square inch, and air under the new lower pressure passes the check valve 49, bypasses the pressue relief valve 47 and travels through the air passages 42 and 43 to the reverse acting chambers 19 of the respective rams 11 and 12.

As air is consumed in moving the piston in the reverse direction the pressure in the air receiver 55 may fall below the sequence valve 40 setting, in this example 60 psi. If that should happen, pilot operated valve 54 will shift back to its original position allowing air to flow from lines 36 and 35 through the valve and out to the atmosphere, allowing the reverse action to continue.

When the rams have become completely closed or should closing of the rams be stopped at any point the reverse acting movement is stopped in the manner as has been previously indicated, namely, by applying air under pressure again from the source 25 or 27 to the selector valve 26 to repressurize the forward acting chambers 18. Whenever there is movement of the piston downwardly in the chosen example air from the reverse acting chambers 19 is vented through the pressure relief valve 47 which is set at a pressure slightly higher than the pressure of the pressure regulator 48.

In both forms of the system as shown in FIGS. 1 and 2 there is provided a constantly open vent 56 which is in communication with the pilot line 41 and sequence valve means 40 whereby ultimately to reduce pressure in the pilot line 41, when the sequence valve no longer supplies air to line 41 due to the pressure in the air receiver falling below the preset sequencing pressure (60 psi), causing the pilot operated valve 34 or 54 as the case may be, to reassume initial position, namely, a position that exhausts the forward acting chambers 18 and redirects any newly applied air pressure to the air receiver while blocking its flow through the pilot operated valve.

Figure 3:
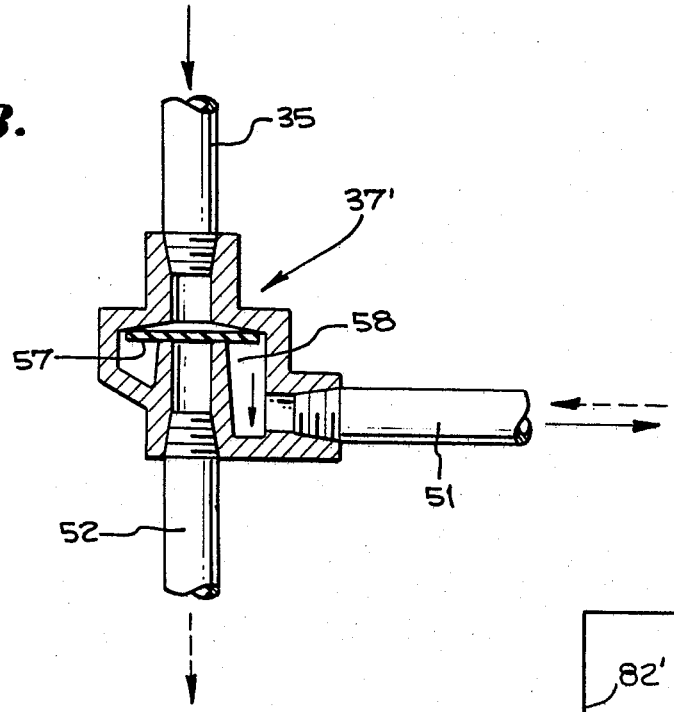
FIG. 3 is a longitudinal sectional view of a typical quick exhaust valve usable with the system of FIG. 1.

A typical quick exhaust valve suited to the system is one shown in FIG. 3, identified by reference character 37′. In a valve of this description when the forward acting chamber is to be supplied with air under pressure air flows from the air passage 35 to a location above a double acting flexible diaphragm 57. Since the edge of the diaphragm is flexible the edge is permitted to deflect to allow air under pressure to travel through an inside passage 58 and from there to the air passage 51 which supplies the forward acting chamber 18.

When air pressure is discontinued in the air passage 35 and movement of the piston 13 reversed air flow is reversed in the air passage 51 and inside passage 58 the effect of which is to shift the position of the diaphragm upwardly to a location where flow is blocked into the air passage 35. Movement of the diaphragm blocking the air passage 35 at the same time opens flow to the exhaust 52 and in this way the forward acting chamber 18 is immediately and quickly exhausted.

Figure 4:
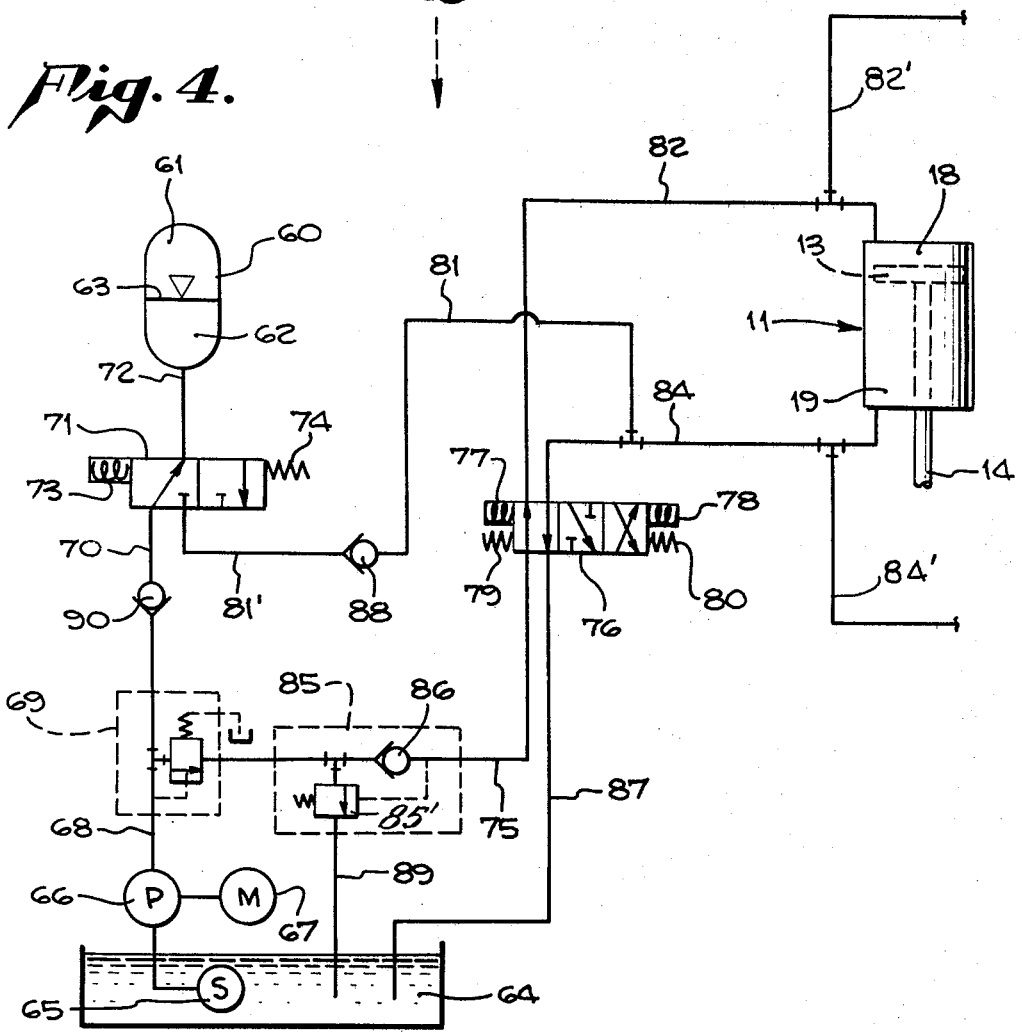
FIG. 4 is a schematic representation of the system in a form capable of using liquid under pressure.

In the arrangement of the system as shown in FIG. 4 to which this divisional application is directed where liquid hydraulic fluid is employed, use is made of a gas charged hydraulic accummulator 60 as a container. The accummulator includes a gas chamber 61 and a liquid chamber 62 separated by a flexible diaphragm 63. Hydraulic liquid is contained in a reservoir 64 from which it is drawn through a strainer 65 by a pump 66 operated by a motor 67. Liquid at pump pressure is passed through a liquid line 68 to a sequence valve means 69 then through a liquid line 70 and three-way two position control valve member 71, through another liquid line 72 to the liquid chamber 62 of the accummulator. The control valve member 71 is operated by means of a solenoid 73 and by action of a spring 74. With power to the pump motor 67 on, the valve assumes the adjustment shown in FIG. 4 where the liquid passage is open from the source to the accummulator 60.

Also in communication with the sequence valve means 69 through a liquid line 75 is a four-way three position control valve member 76. Solenoids 77 and 78 accompanied by springs 79 and 80 are employed to manipulate the control valve member 76.

A liquid line 81', 81 provides communication between the control valve member 71 and a liquid branch 84. Another liquid branch line 82 provides communication between the forward acting chamber 18 of the ram 11 and also the corresponding forward acting chamber of the ram 12 (not shown in FIG. 4) and control valve member 76. The reverse acting chamber 19 is placed in communication with the control valve member 76 by means of the liquid line 84. Lines 82' and 84' supply a twin ram (not shown) in this example but a second ram is not necessary to the functioning of the system.

To prevent overloading the system of FIG. 4 there is additionally provided an unloading relief valve 85 in the liquid line 75 coupled with a check valve 86 permitting flow through the liquid line 75 to the control valve 76. There is also an exhaust liquid line 87 from the control valve member 76 to the reservoir 64.

In operation, let it be assumed that forward action of the ram 11 and piston 13 is at 1,200 pounds per square inch. In this event the sequence valve means 69 is set for operation at 1,200 pounds per square inch. For this type of system the sequence valve means 69 will direct passage of liquid under pressure past a check valve 90 to the control valve 71 which, by means of solenoid 73 being in direct communication with electric power to the pump motor 67, will assume the position shown in FIG. 4 and allow passage of liquid to the accummulator 60 while at the same time prevent flow of liquid under pressure through the liquid line 75, until a pressure of 1,200 pounds per square inch has been built up in the accummulator 60. When this happens, and with the control valve member 76 set in the position shown in FIG. 4, by means of electrical power at the solenoid 73 which is in direct communication with the electrical power to the motor 67, liquid under pressure passes through the liquid lines 75 and 82 to the forward acting chamber 18 of the ram 11, causing the piston 13 to be moved downward as shown in FIG. 4. Meanwhile, any liquid present in the reverse acting chamber 19 flows outwardly through the liquid line 84, through the control valve member 76 to the exhaust liquid line 87 and then back to the reservoir 64. Fluid is prevented from flowing from the reverse acting chamber 9 toward the valve 71 via line 81, 81' by action of the check valve 88 as the chamber 19 is exhausting.

When reverse operation is desired, by proper manipulation of the solenoids 77 and 78 namely deenergize solenoid 77 and energize solenoid 78, the control valve member 76 is shifted from left to right and as shown to the extreme position wherein travel of liquid through the control valve member 76 is reversed. This means that liquid under pressure from the liquid line 75 is passed through the liquid line 84 to the reverse acting chamber 19 to cause the piston 13 and piston rod 14 to move upwardly. At the same time exhaust is accomplished from the forward acting chamber 18 by liquid therein passing through the liquid line 82 through the control valve member 76 and thence through the exhaust liquid line 87 to the reservoir 64.

Irrespective of whether the piston is acting in forward or in reverse dejection, by suitable conventional electtrical connections, when the control valve member 76 has been set to pass liquid under pressure to either one or the other of the chambers 18 or 19 of the ram 11, the control valve member 71 is set to an adjustment by means of power to the solenoid 73, wherein flow from the liquid line 70 is opened to the accumulator 60 and flow from the liquid chamber 62 and liquid line 72 is prohibited from flowing through the control valve member 71 by the check valve 90 in the liquid line 70. If however, through leakage or some other means pressure in the liquid chamber 62 falls below the selected pressure (1200 psi) the sequence valve 69 will replenish chamber 62 before any more fluid can flow to the line 75 insuring the proper pressure in the accummulator 60, and also volume.

In this form of device operation in both forward and reverse directions is done under the same 1,200 pounds per square inch condition, the pressure in the accumulator 60 being maintained by the sequence valve 69.

For holding the piston 13 in any one position the solenoid valve arrangement operates in a fashion such that the control valve 76 is moved to center position by springs 79 and 80 when solenoids 77 and 78 are both deenergized wherein liquid flow from the liquid line 84 is blocked. There is no movement of liquid in the liquid line 75 by reason of the shift in position of the control valve member 76 to the center position shown in FIG. 4.

Should movement of the piston rod 14 be blocked for any reason while the pump and motor continue to operate to the extent that pressure gets built up in the system to a level significantly above 1,200 pounds per square inch, the unloading relief valve 85 including a valve number 85' set at a slightly higher pressure and acting as a vent, for example 1,500 pounds per square inch, is adapted to actuate releasing liquid at the higher pressure to pass through a liquid release line 89 and thus back to the reservoir 64.

In the event of failure of electrical power after the piston 13 has been moved to the forward limit, or any portion of the forward operation, there is still the capability to automatically return the piston to initial position. With the control valve member 76 in a position of adjustment in the center as it would be when neither solenoid was energized (i.e. power failure), with the control valve member 71 set in its left hand position as would happen when the solenoid 73 had no power allowing spring 74 to move the valve, liquid under pressure from the liquid chamber 62 of the accumulator 60 can flow through a line 81', past the check valve 88, through the liquid lines 81 and 84 to the return chamber 19, there having been built up prior to initial operation enough liquid pressure and volume in the accumulator 60 to complete the cycle, by means of sequence valve 69. The action described consequently moves the piston 13 upward to its original position. While piston 13 is moving upward, fluid in chamber 18 flows through line 82 through valve 76 in its center position, since with no power springs 79 and 80 move it to the center position allowing fluid to escape through the line 87 into the reservoir 64.

Having described the invention, what is claimed as new in support of Letters Patent is as follows:

1. In a system for performing work by operation of a hydraulic ram having a piston therein forming in said ram a forward chamber and a reverse chamber, said system comprising a source of fluid at operating pressure, a fluid pressure storage container including fluid passage means connecting said container to said source, operating valve means having fluid passage means interconnecting said operating valve means with said source, said container and said ram for selectively directing fluid at said operating pressure to said chamber, said operating valve means having one adjustment wherein said operating pressure is passed to said forward chamber and said reverse chamber has a connection to exhaust, sequence valve means interconnected respectively to said container, said source and said control valve means, and energizing means for said valve means, said sequence valve means having an adjustment at pressures less than said operating pressure which inhibits passage of fluid by said operating valve means to said chambers until said container is at said operating pressure, said operating valve means having another adjustment wherein said operating pressure is passed to said reverse chamber and said forward chamber has a connection to exhaust.

2. A system as in claim 1 wherein said operating valve means has an adjustment when deenergized interconnecting said storage container with said reverse chamber and said forward acting chamber to exhaust.

3. A system as in claim 1 wherein said sequence valve means is in operative association with an unloading vent operative to prevent overloading said system with fluid pressure.

4. A system as in claim 1 wherein said container has a gas chamber, a liquid chamber and a movable separator therebetween, the liquid chamber being in communication with said sequence valve means.

5. A system as in claim 4 wherein said source of fluid comprises a liquid reservoir and a power operated pump.

6. A system as in claim 5 wherein there is an unloading relief valve connected respectively to said sequence valve means and said operating valve means, said unloading relief valve having a pressure setting in excess of said operating pressure and a discharge from said relief valve to said reservoir.

7. A system as in claim 4 wherein said operating valve means comprises two valve members, one of said members having one adjustment wherein the liquid chamber is connected to said sequence valve means and disconnected from said ram and another adjustment wherein the liquid chamber is disconnected from said sequence valve means and connected to said ram.

8. A system as in claim 4 wherein said operating valve means comprises two valve members, a second of said valve members having a first adjustment wherein said sequence valve means is connected to a first of said ram chambers with a second of said ram chambers connected to exhaust and a second adjustment wherein said second of said ram chambers is connected to said sequence valve means with said first of said ram chambers connected to exhaust.

9. A system as in claim 8 wherein said second of said valve members has a third position wherein the fluid passage means from said sequence valve means to said operating valve means is blocked.

10. A system as in claim 4 wherein said operating valve means comprises two valve members, one of said valve members having one adjustment wherein the liquid reservoir is connected to said sequence valve means and disconnected from said ram and another adjustment wherein the liquid chamber is disconnected from said sequence valve means, the other of said valve members having a first adjustment wherein said sequence valve means is connected to the first of said ram chambers and a second of said ram chambers is connected to exhaust, and a second adjustment wherein said second of said ram chambers is connected to said sequence valve means and said first of said ram chambers is connected to exhaust.

* * * * *

UNITED STATES PATENT OFFICE

CERTIFICATE OF CORRECTION

PATENT NO. : 4,085,587

DATED : April 25, 1978

INVENTOR(S) : ROLAND E. GARLINGHOUSE

It is certified that error appears in the above-identified patent and that said Letters Patent are hereby corrected as shown below:

The correct name of the patentee is:

ROLAND E. GARLINGHOUSE

In Claim 1, column 7, lines 42 and 43, delete "said control valve means" and substitute --said operating valve means--.

Signed and Sealed this

*Twenty-fifth* Day of *November 1980*

[SEAL]

*Attest:*

SIDNEY A. DIAMOND

*Attesting Officer*

*Commissioner of Patents and Trademarks*